US005274975A

United States Patent [19]

Haag

[11] Patent Number: 5,274,975

[45] Date of Patent: Jan. 4, 1994

[54] WALL CAP AND EAVE RAKE

[76] Inventor: E. Keith Haag, 1007 W. Steels Corners Rd., Cuyahoga Falls, Ohio 44223

[21] Appl. No.: 891,426

[22] Filed: May 29, 1992

[51] Int. Cl.[5] ..... E04H 12/00

[52] U.S. Cl. ..... 52/300; 52/238.1; 52/239; 52/241; 52/465

[58] Field of Search ..... 52/300, 239, 242, 238.1, 52/241, 731.2, 731.3, 731.7, 732.2, 465

[56] References Cited

U.S. PATENT DOCUMENTS

| | | | |
|---|---|---|---|
| 1,998,448 | 4/1935 | Crowe . | |
| 2,159,296 | 5/1939 | Sharp | 52/300 |
| 2,850,771 | 9/1958 | Wagner . | |
| 2,918,151 | 12/1959 | Kennedy . | |
| 3,066,770 | 12/1962 | Millard et al. | 52/239 |
| 3,229,431 | 1/1966 | Paul . | |
| 3,284,966 | 11/1966 | Bolt . | |
| 3,388,514 | 6/1968 | Archinal et al. . | |
| 3,397,494 | 8/1968 | Waring . | |
| 3,397,496 | 8/1968 | Sohns . | |
| 3,423,891 | 1/1969 | Burris . | |
| 3,662,507 | 5/1972 | Espeland . | |
| 3,675,382 | 7/1972 | Lickliter et al. | 52/239 |
| 3,738,083 | 6/1973 | Shimano | 52/582 |
| 3,783,563 | 1/1974 | Moore . | |
| 3,828,502 | 8/1974 | Carlsson . | |
| 3,866,381 | 2/1975 | Eschbach et al. . | |
| 3,992,839 | 11/1976 | LaBorde . | |
| 3,996,712 | 12/1976 | Howell | 52/300 |
| 4,183,185 | 1/1980 | Farge . | |
| 4,557,091 | 12/1985 | Auer . | |
| 4,655,019 | 4/1987 | Rejc | 52/239 |
| 5,065,556 | 11/1991 | DeLong et al. | 52/239 |

*Primary Examiner*—Carl D. Friedman
*Assistant Examiner*—Christopher T. Kent
*Attorney, Agent, or Firm*—Renner, Kenner, Greive, Bobak, Taylor & Weber

[57] ABSTRACT

A cap means embodying the concepts of the present invention is adapted to be supported on the upper extremity of the interior walls, the end walls and the connectors by which the successive panel members are joined to provide the interior and/or the end walls of a modular building structure. Such a cap means has a generally rectangular body portion that presents a substantially flat base which is adapted to be supported upon the upper extremity of wall members in the modular building. Mounting flanges extend downwardly from the base to embrace the wall on which the cap means is supported. A connecting means is located in spaced relation upwardly of the base, and one or more electrical cable races may be provided in the cap means between the base and the connecting means. The substantially flat top wall of the connector means is adapted to support roof panels, and a decorative bargeboard employed in conjunction with the roof, when the cap means is used in conjunction with an end wall, and to support decorative and/or functional privacy panels or a ridge beam, when used in conjunction with an interior wall.

12 Claims, 5 Drawing Sheets

WALL CAP AND EAVE RAKE

TECHNICAL FIELD

The present invention relates generally to modular building structures. More particularly, the present invention relates to multi-purpose, multi-functional cap means for modular building structures, the building structures to be constructed with a plurality of prefabricated structural components and being particularly adapted for use in third world countries. Specifically, the present invention relates to a novel cap means adapted to be employed as a connector and/or a closure. That is, the cap means may be employed as a wall cap for closing an interior wall and for providing an eave rake to close an end wall of a structure. In addition, the cap means may, when desired, serve as a connector between the top of a wall and structure supported thereby. The cap means is, therefore, particularly adapted for use in conjunction with modular building structures that can be erected in a relatively short time with the simplest of tools, and without the need for craftsmen skilled in the building trades.

BACKGROUND OF THE INVENTION

It is well known in the construction industry that significant economic savings can be realized by reducing the amount of work required at the construction site. To achieve this objective, prefabrication has been adopted on a large scale in the construction industry, both with respect to general purpose buildings and with respect to personal housing. For example, some sources have estimated that as many as forty percent (40%) of the homes now being built use some form of premanufactured structural components. Moreover, four and seven-tenths percent (4.7%) of all housing starts in the United States in 1991 are homes that are completely modular, and this percentage is expected to rise. The ultimate goal to be achieved in building modular structures has been to produce, at a remote site and in a factory environment, as many of the components of a given structure as possible, leaving only site preparation and final assembly to be done at the actual location where the building is to be situated.

There are a number of advantages to be achieved by prefabrication. The most obvious of those advantages is the significant reduction of time and labor required at the job site, where labor costs are normally the highest. In addition to the reduced time required for actual erection of the building, other time savings are also possible. For example, the reduced amount of work time at the job site diminishes the potential for interruptions resulting from inclement weather. Reduced time at a job site can also drastically reduce the potential for work-related injuries and/or deaths. A controlled factory atmosphere is inherently amenable to measures for reducing injuries and increasing safety.

Furthermore, increased uniformity of the structural components resulting from the enhanced quality control possible in a factory atmosphere and the economic advantages of mass production techniques are also achievable with the prefabrication approach. As is often the situation, the use of standardized, prefabricated structural components not only improves the uniformity of the end product but also greatly simplifies the actual erection process. This last feature also makes it possible to produce quality buildings with unskilled, or minimally skilled, personnel. Thus, the overall results of prefabrication in the construction industry include greatly improved efficiency, significantly reduced costs, lower accident rates and better safety records.

These advantages are, of course, desirable in any type of construction, but are believed to be especially important in the production of individual dwellings, particularly in economically distressed areas and in third world countries where cost is one of the most significant obstacles to overcome.

There are a wide variety of practical ways of to effectuate the prefabrication concept.

For example, the Crowe U.S. Pat. No. 1,998,448 discloses the factory prefabrication of steel frame panel units of standard dimensions which are filled with cementitious material and assembled so as to leave vertical spaces between adjacent vertical walls for utility connection and with laterally adjacent panels being joined by cover strips or slabs which are interconnected thereto.

The Wagner U.S. Pat. No. 2,850,771 discloses a prefabricated construction system wherein wooden panels are interconnected to vertical posts or columns with the vertical edges of the wooden wall panels and the posts having grooved areas and with spline blocks being used to interconnect the two.

The Paul U.S. Pat. No. 3,229,431 is indicative of another approach wherein a so-called "frameless" modular multi-story building is constructed from self-contained prefabricated modules which are simply set on a building foundation and attached thereto by anchor bolts secured in the foundation.

The Bolt U.S. Pat. No. 3,284,966 is of general interest in showing a prefabricated building which can be readily assembled, or erected, at the job site and which is collapsible for transportation purposes.

The Moore U.S. Pat. No. 3,783,563 discloses a prefabricated building constructed of panels formed of molded plastic material, reinforced with glass fibers, and wherein the panels have channels or ribs on their edges adapted to mate with complementary structures of connector members.

Other examples of prefabricated construction components utilizing various plastic materials can be seen in the Kennedy U.S. Pat. No. 2,918,151; the Espeland U.S. Pat. No. 3,662,507; the Sohns U.S. Pat. No. 3,397,496; and, the Farge U.S. Pat. No. 4,183,185.

The foregoing patents are believed to be generally representative of the prior art, and that art does illustrate some diverse approaches to the prefabrication of buildings using various materials. However, none of the aforesaid prior art patents, nor any other prior art with which the inventor is aware, either alone or in combination, achieve the several objects of the present invention.

Other more advanced structures are disclosed in U.S. patent applications Ser. No. 07/792,356, filed Nov. 14, 1991; Ser. No. 07/875,097, filed Apr. 28, 1992 and Ser. No. 07/893,532, filed Jun. 4, 1992, the subject of each the aforesaid applications are the inventions of the present inventor and are incorporated herein by reference. The aforesaid applications describe various aspects of modular building structures with which the present invention can be advantageously employed.

SUMMARY OF THE INVENTION

It is, therefore, a primary object of the present invention to provide an improved cap means for a modular building structure.

It is another object of the present invention to provide a cap means, as above, that can be used structurally to close the open edge of one or more wall, or roof, panel members with relatively unskilled laborers, and without specialized tools.

It is a further object of the present invention to provide a cap means, as above, in the nature of an eave rake that may simultaneously serve to close the open, upper edge of an end wall and to provide a platform on that end wall for supporting the roof panel members of the modular structure in which the eave rake is incorporated.

It is still another object of the present invention to provide a cap means, as above, that can be mass produced at relatively modest expense and can then be conveniently shipped to a remote construction site, also at relatively modest cost.

It is yet another object of the present invention to provide a cap means, as above, that may be adapted to permit the routing of electrical cable therethrough, even after erection of the structure and with a much reduced potential for work-related injuries than with more traditional construction methods.

It is a still further object of the present invention to provide a cap means, as above, a majority of the structural components for which may be prefabricated in a controlled working environment that inherently leads to reduced injuries and increased safety.

These and other objects of the invention, as well as the advantages thereof over existing and prior art forms, which will be apparent in view of the following detailed specification, are accomplished by means hereinafter described and claimed.

In general, a cap means embodying the concepts of the present invention is adapted to be supported oil the Lipper extremity of the interior walls, the end walls and the connectors by which the successive panel members are joined to provide the interior and/or the end walls of a modular building structure. Such a cap means has a generally rectangular body portion that presents a substantially flat base which is adapted to be supported upon the upper extremity of wall members in the modular building. Mounting flanges extend downwardly from the base to embrace the wall on which the cap means is supported. A connecting means is located in spaced relation upwardly of the base, and one or more electrical cable races may be provided in the cap means between the base and the connecting means. The substantially flat top wall of the connector means is adapted to support roof panels, and a decorative bargeboard employed in conjunction with the roof, when the cap means is used in conjunction with an end wall, and to support decorative and/or functional privacy panels or a ridge beam, when used in conjunction with an interior wall.

The present invention is described in conjunction with one exemplary embodiment of a cap means. However, that cap means is shown and described not only in association with interior walls but also in the situation when the cap means is employed in conjunction with an end wall as an eave rake. The exemplary cap means is described in detail without attempting to show all of the various forms and modifications in which the invention might be embodied; the invention being measured by the appended claims and not by the details of the specification.

DESCRIPTION OF AN EXEMPLARY EMBODIMENT

Figure 1:
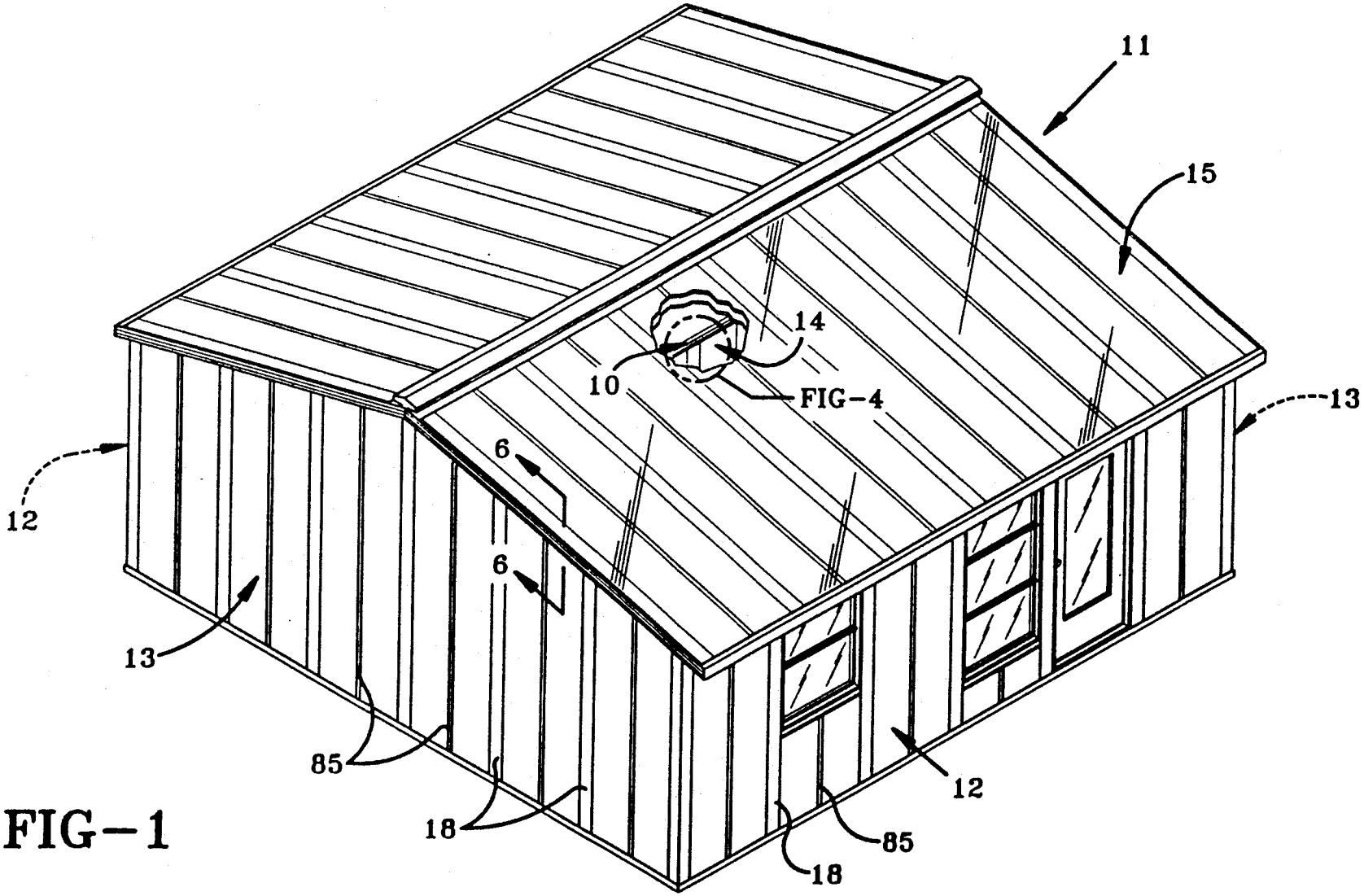
FIG. 1 is a perspective view of a modular building incorporating the present invention.

One representative form of a cap means embodying the concepts of the present invention is designated generally by the numeral 10 on the accompanying drawings. The representative cap means 10 (as best seen from FIGS. 2 and 3) may, for example, be employed in a building structure 11, shown in FIG. 1, which could serve as residential living quarters or a commercial office. The composite building structure 11 depicted employs exterior support walls 12, end walls 13, one or more interior walls 14 and a roof 15 that are modular. The cap means 10 is particularly suited for use with a building 11.

Figure 4:
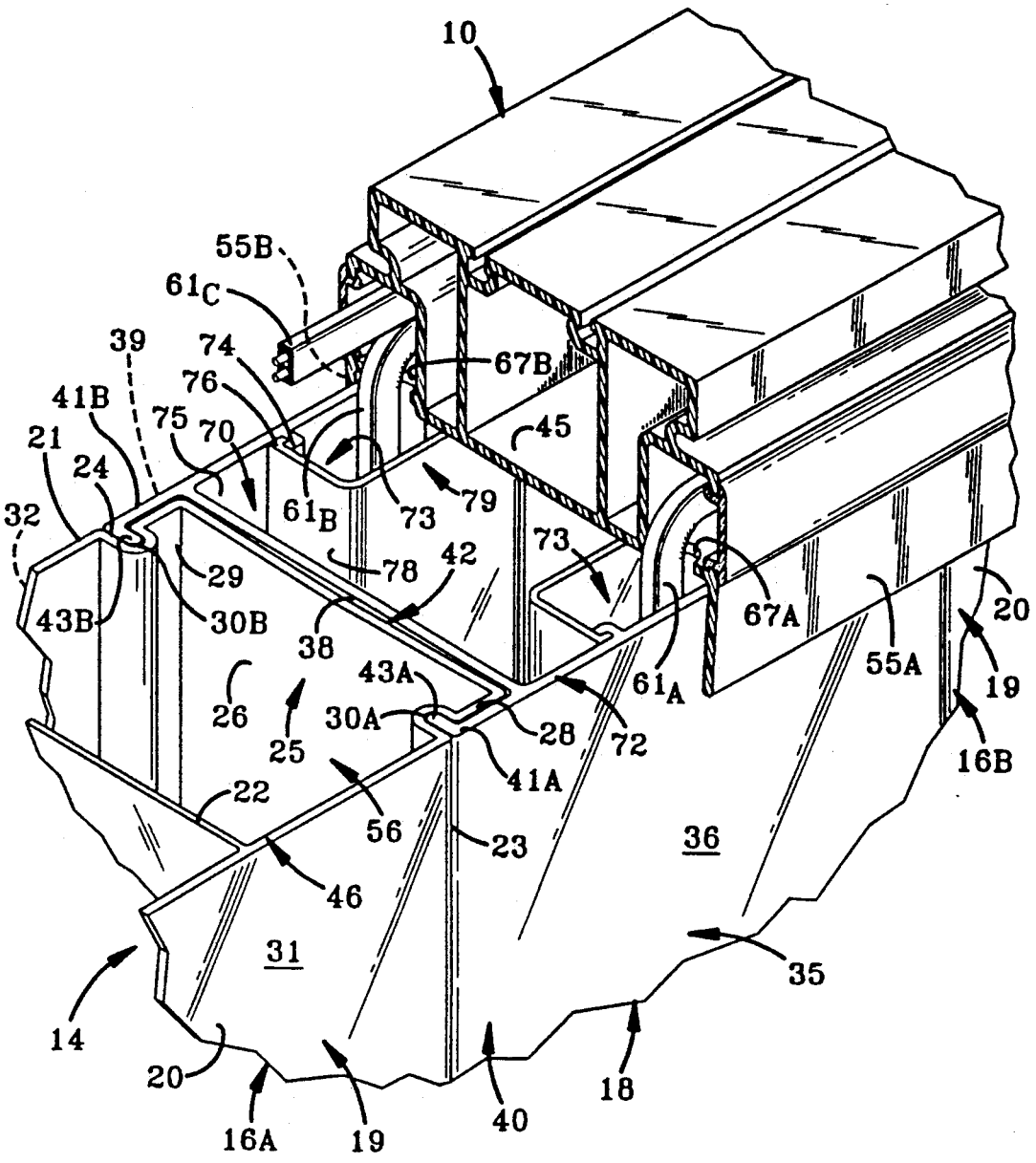
FIG. 4 is a perspective view of the subject cap means installed on an exemplary interior wall and taken substantially at the circle identified as "FIG. 4" in FIG. 1.
Figure 5:
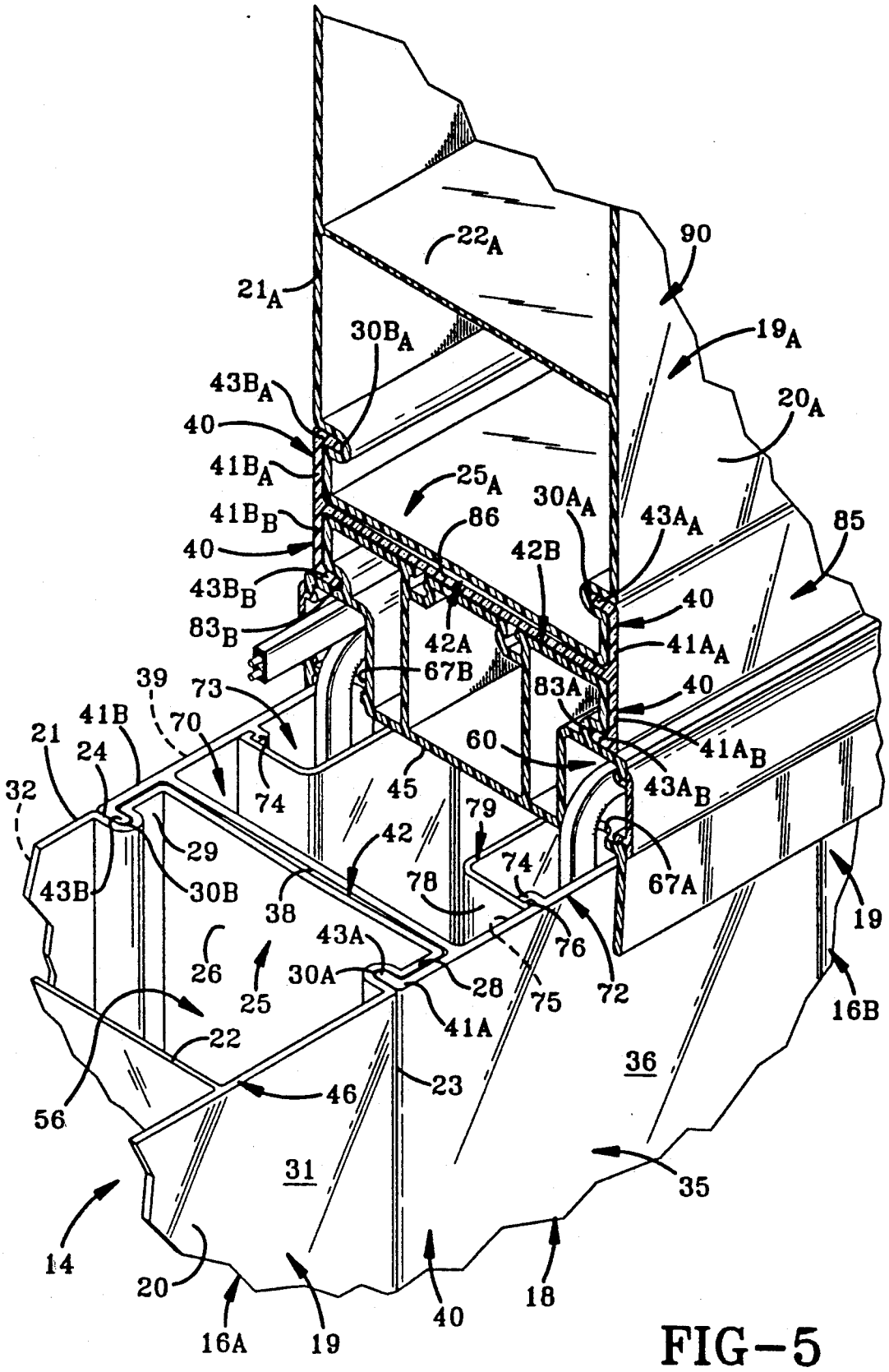
FIG. 5 is a perspective representation of an interior wall panel interconnected, through the cap means, with a ridge beam; and, FIG. 6 is a vertical section taken along line 6—6 of FIG. 1 depicting an end wall and a cap means used as an eave rake.

That portion of an interior wall 14, represented in FIGS. 4 and 5, is formed by a successive plurality of longitudinally aligned panel members 16—a portion of two such panel members 16A and 16B are depicted in the linear alignment which results when they are structurally joined by a panel connector 18.

As previewed in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation utilized for general identification of that structural member, component or arrangement. Thus, there are at least two panel members which are generally identified by the numeral 16, but the two specific, individual panel members depicted are, therefore, identified by the alphanumeric designators 16A and 16B in the specification and on the drawings. This same suffix convention shall be employed throughout the specification.

Returning to the description of the arrangement depicted in FIGS. 4 and 5, the wall panel members 16 each have a body portion 19. The body portion 19 has planar, transversely spaced, substantially parallel, skin walls 20 and 21. A plurality of reinforcing ribs or webs 22 extend transversely between the skin walls 20 and 21. The ribs 22 are, themselves, laterally spaced, one with respect to the others, and they are oriented substantially parallel to the longitudinal edges of the body portion 19—i.e., perpendicularly with respect to the skin walls 20 and 21.

The longitudinal edges of the body portion 19 are delineated by positioning shoulders 23 and 24 presented at the opposite ends of each skin wall. As depicted in FIGS. 4 and 5, a positioning shoulder 23 defines one longitudinal edge of skin wall 20 on panel 16A, and a corresponding, and laterally spaced, positioning shoulder 24 defines one longitudinal edge of skin wall 21 of panel 16A. The positioning shoulders 23 and 24 thus define one longitudinal edge of the body portion 19 on panel 16A as well as the offset juncture between the body portion 19 and the connecting tongue 25 which extends longitudinally outwardly from that edge of the body portion 19 on panel 16A defined by the positioning shoulders 23 and 24.

Similarly, a positioning shoulder, not shown, defines the opposed, longitudinal edge of skin wall 20 on panel 16B, and a corresponding positioning shoulder, also not shown, defines the opposed longitudinal edge of wall skin 21 on panel 16B. The positioning shoulders on panel 16B are laterally spaced from each other, and—when the panel member 16A and 16B are linearly aligned—the positioning shoulders on panel 16B are longitudinally opposed to the positioning shoulders 23 and 24 on panel 16A. As in panel 16A, the positioning shoulders on panel 16B define one longitudinal edge of the body portion 19 on panel 16B as well as the offset juncture between the body portion 19 and the connecting tongue 25 which extends longitudinally outwardly from that longitudinal edge of the body portion 19 on panel 16B defined by its positioning shoulders.

The connecting tongues 25 each have a transversely oriented closure wall 26 that is spaced longitudinally outwardly from the longitudinal edge of the body portion 19 defined by the positioning shoulders 23 and 24. The transverse edges of the closure wall 26 are joined to transversely spaced, longitudinally extending, locking walls 28 and 29. Vertically extending locking grooves 30A and 30B are recessed into each connecting tongue 25 between the respective locking wall 28 and 29 and the body portion 19 such that locking grooves 30A and 30B lie parallel to shoulders 23 and 24, respectively, of panel 16A.

The locking walls 28 are laterally offset with respect to the longitudinally and vertically oriented plane within which the exposed surface 31 on skin wall 20 is disposed, and the locking walls 29 are laterally offset with respect to the longitudinally and vertically oriented plane within which the exposed surface 32 on skin wall 21 is disposed. It is these lateral offsets of the locking walls 28 and 29 relative to the respective exposed surfaces 31 and 32 on the two skin walls 20 and 21 which results in the transverse, or laterally measured, thickness of the tongues 25 being less than the transverse, or laterally measured, thickness of the body portion 19 on either panel member 16A or 16B. The functional purpose for this deliberate disparity between the transverse thickness of the tongues 25 relative to the transverse thickness of the body portion 19 in each panel member 16 accommodates the panel connector 18, as will now be explained.

With continued reference to FIGS. 4 and 5, the panel connector 18 is employed to effect a structural tie between the two, linearly oriented panel members 16A and 16B. Typically, a panel connector 18 has a body portion 35 that is preferably of box-shaped cross section. That is, the body portion 35 is hollow and has a generally rectilinear, external periphery which defines a plurality of exterior faces such as the three 36, 38, and 39 depicted. The box-shaped cross section provides excellent bending strength with minimal material as well as excellent columnar strength with a superb L/R ratio.

Connecting flanges 40 are presented from the body portion 35 in oppositely extending pairs. Each flange 40 has an extension arm 41 with ends that are proximal and distal with respect to the body portion 35 from which each extension arm 41 is presented. The proximal end portion of each extension arm 41 is integral with the body portion 35 in such a manner that each extension arm is oriented in perpendicular relation with respect to one face and at the same time is oriented in longitudinal alignment—ie.: coplanar—with an adjacent face on the body portion 35.

As can best be seen with reference to FIG. 4, the extension arm 41A is oriented not only in perpendicular relation with respect to the exterior face 38 but also in coplanar relation with respect to exterior face 36. Likewise, the extension arm 41B is oriented not only in perpendicular relation with respect to the face 38 but also in coplanar relation with respect to the exterior face 39. The extension arms 41A and 41B are thus disposed in transversely spaced, parallel relation to form a first socket, or connection receptacle, 42.

A locking pawl 43 extends transversely outwardly from the distal end portion of each extension arm 41. Specifically, locking pawl 43A is presented from the distal end portion of the extension arm 41A, and pawl 43B is presented from the distal end portion of the extension arm 41B. The pawls 43A and 43B so provided extend toward each other in facing opposition in the first socket, or connection receptacle, 42.

The panel connector 18 also presents a second socket comprising a pair of extension arms which are identical with the extension arms 41 but which extend outwardly from the body portion 35 in a diametrically opposite direction relative to the first pair of extension arms 41A and 41B, respectively. The structure, and function of those second extension arms are substantially identical to the structure and function of the first pair of extension arms 41A and 41B described herein and need not, therefore, be further described. However, should a more in depth description be desired, one may refer to my copending application Ser. No. 07/792,356, filed on Nov. 14, 1991, the description in which is incorporated herein by reference.

The heretofore defined wall panel members 16 and the panel connectors 18 permit the walls 12, 13 and/or 14 to be either directly assembled in their final, vertical disposition, or assembled at ground level and then raised into their final, vertical position. Either approach is acceptable, but there will likely be those who prefer one method over the other.

To erect a wall in situ at least one laborer will require a ladder, stilts or some form of scaffolding. In this situation two sequential panel members 16A and 16B may be positioned in linearly spaced juxtaposition, as shown in FIGS. 4 and 5, and a laborer on the scaffolding, or the like, may take a coupling connector 18 and slide it vertically between the linearly spaced, and aligned, panel members 16A and 16B such that the connecting receptacle 42 on the panel connector 18 operatively engages the connecting tongue 25 on panel 16A and the oppositely directed socket, or connecting receptacle, (not shown) on the panel connector 18 operatively engages an identical connecting tongue (not shown) on panel member 16B.

Operative engagement of the connecting sockets 42 on the panel connector 18 with the tongues 25 on the panel members 16 requires that the locking pawls 43 in the connection receptacles 42 mesh with the locking grooves 30 associated with each the connecting tongue 25. In fact, the locking pawls 43 are slidably received within the locking grooves 30. So engaged, the panel member 16A and 16B are structurally tied to the panel connector 18, and thus to each other.

Continued reference to FIGS. 4 or 5 will also reveal the functional purpose of having the connecting tongues 25 of lesser transverse thickness than the thickness of the body portion 19 of the panel members 16 from which the tongues 25 are presented. By making the transverse offset between each locking wall 28 and 29 and the appropriate skin wall 20 or 21 on the panel members 16 equal to the transverse thickness of each extension arm 41 of the panel connector 18, the exterior faces 36 and 39, respectively, on the panel connector 18 will be located coplanar with the respective surfaces 31 and 32 of the skin walls 20 and 21 on the panel members 16. With all the transverse offsets between the skin walls 20 and 21 on the panel members 16 and the corresponding locking walls 28 and 29 on the connecting tongues 25 being so dimensioned, both surfaces 31 and 32 on any panel member 16 in any wall 12, 13 or 14 so constructed will be virtually flush with the corresponding surfaces on the other panel members 16 in that wall, as well as with the appropriate faces 36 and 39 on the panel connectors 18 used to interconnect the panel members 16.

The panel members 16, the panel connectors 18 described above, as well as those structural members which will be hereinafter described, may well comprise an extruded thermoplastic resin. Such resins are preferably reinforced with fibers such as glass fibers and provide a material commonly referred to as a fiber-reinforced plastic (FRP). While a variety of thermoplastic materials and fiber reinforcements are known, one particularly suitable FRP comprises vinyl chloride resins reinforced with glass fibers.

The amount of fiber reinforcement in such a product can range: broadly from about five to fifty percent (5% to 50%) by weight, based upon the combined weight of glass fibers and vinyl chloride resin; desirably from about ten to forty percent (10% to 40%) by weight; preferably from about fifteen to thirty-five percent (15% to 35%) by weight; and, most preferably about thirty percent (30%) by weight. A sufficient disclosure of these products and the process for their preparation can be found in U.S. Pat. No. 4,536,360, the subject matter of which is incorporated herein by reference.

As should be evident to those skilled in the art, practice of the present invention does not require that the structural components comprise vinyl chloride resins reinforced by glass fiber and, therefore, the invention is not to be limited thereto or by the disclosure of U.S. Pat. No. 4,536,360. Thus, the structural components may not be fiber reinforced or even thermoplastic so long as they can be manufactured in the configurations described herein. A more complete description of the wall components and the assembly and erection thereof can be found in the previously identified U.S. application Ser. No. 07/792,356.

As best seen in FIGS. 4 and 5, the upper extremity 46 of the panel members 16 forming the interior wall 14 supports, and is thereby capped, or closed, by the cap means 10. The cap means 10 has a body portion 44 which presents a generally rectilinear appearance, the lower side of the generally rectilinear body portion 44 is comprised, in part, of a transverse base wall 45 supported on at least a portion of the tipper extremity 46 of the interior wall 14.

In the embodiment of the cap means 10 described, the transverse base wall 45 may be supported by the web walls 22, but the present invention is not so limited. As is more clearly depicted in FIGS. 2 and 3, a pair of riser, or reinforcing, walls 48A and 48B extend upwardly from the medial portion of the base wall 45 and terminate in, and are integral with, a top wall 50 which defines the upper side of the generally rectilinear body portion 44. The top wall 50 has a pair of receiving grooves 51A and 51B formed therein which are located adjacent to, and laterally inwardly of, the riser, or reinforcing, walls 48A and 48B, respectively. The purpose of the grooves 51 will be hereinafter more fully described.

Intermediate risers 52 extend upwardly from the lateral edges of the base wall 45. The intermediate risers 52A and 52B need extend only for a portion of the distance between the base wall 45 and the top wall 50 in order to intersect the respective, laterally extending race walls 53A and 53B. Base extension walls 54A and 54B extend outwardly from approximately the intersection of the respective intermediate risers 52A and 52B with the base wall 45 to complete the lower portion of the generally rectilinear body portion 44. The base extension walls 54 are, as shown, offset from, but substantially parallel with respect to, the plane of the base wall 45. A mounting flange 55 depends from the distal end of each base extension wall 54. Thus, mounting flange 55A depends from base extension wall 54A, and mounting flange 55B depends from the base extension wall 54B. As shown, for example, in FIGS. 4 and 5, the mounting flanges 55A and 55B closely embrace the faces 36 and 39, respectively, on the panel connector 18, and those same mounting flanges 55A and 55B extend along the outside of the panel members 16 to engage the respective surfaces 31 and 32 thereof. The wall cap 10 thus closes the central cavities 56 (FIGS. 4 and 5) of the panel members 16 as well as the hereinafter more fully described central cavities 70 of the panel connectors 18 by which the panel members 16 may be conjoined into the interior wall 14 under consideration.

Because the base extension walls 54 are offset from the base wall 45, the extension walls 54 cooperate with the mounting flanges 55 to delineate longitudinally extending recesses 58A and 58B which serve cooperatively to interact with an anchor dowel, not shown herein but shown and described in my previously identified, copending U.S. patent application Ser. No. 07/792,356, the description of which is incorporated herein by reference.

Figure 2:
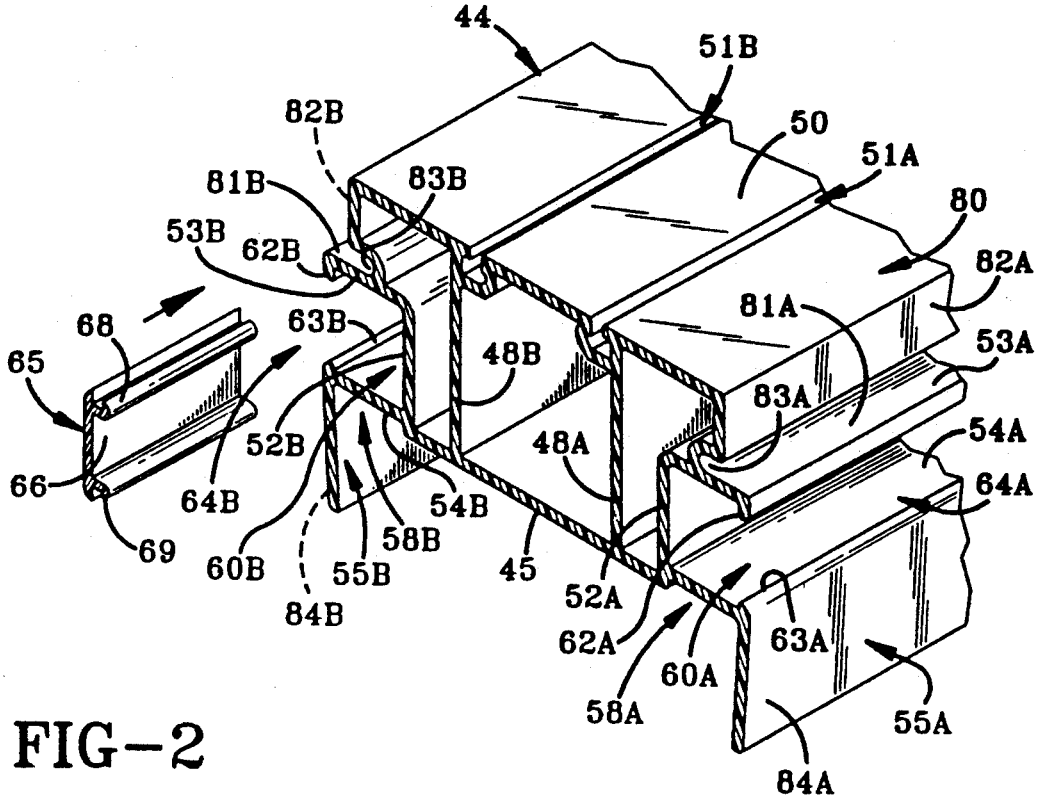
FIG. 2 is an exploded perspective view of a cap means embodying the concepts of the present invention and being provided with a pair of electrical races.
Figure 3:
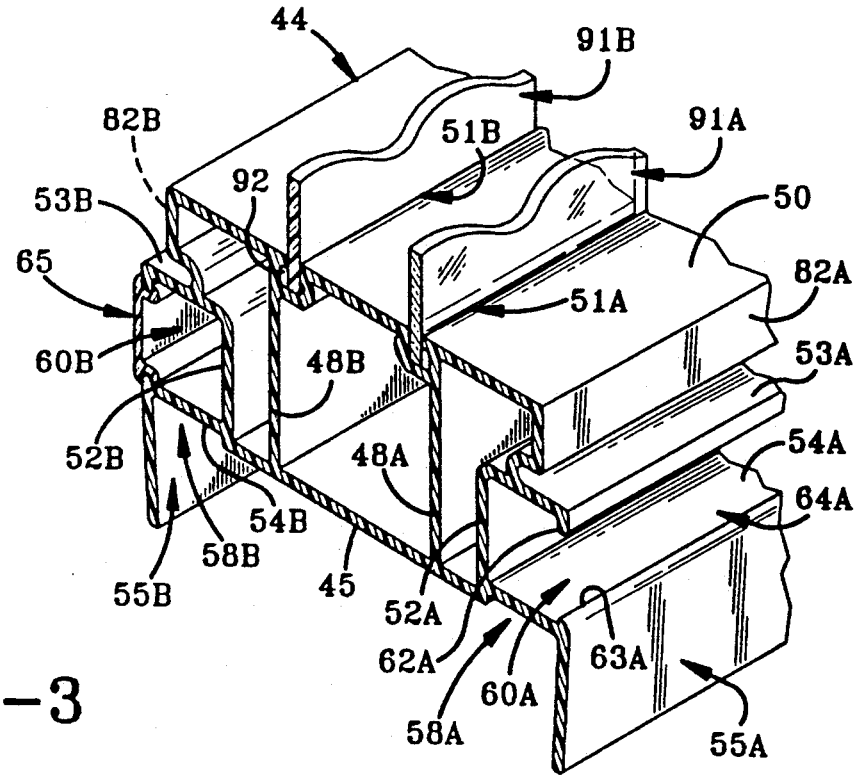
FIG. 3 is a perspective view of the cap means assembled from the exploded disposition depicted in FIG. 2 and employed to support privacy panels.

With continued primary reference to FIGS. 2 and 3, the base extension walls 54, the intermediate risers 52 and the laterally extending race walls 53 cooperatively form one or two elongated channels, or races, 60A and 60B to receive electric wiring, such as the cables $61_A$, $61_B$ and $61_C$ depicted in FIGS. 4 and 5.

The distal end of each race wall 53 terminates in a latching pawl 62, and an opposed latching pawl 63 is provided at the intersection of each base extension wall 54 and the mounting flange 55 conjoined thereto. Each race 60 opens outwardly through an access aperture 64 (FIGS. 2 and 3) located between the opposed latching pawls 62 and 63. As such, the access aperture 64 extends the length of the race 60, and the bounding edges of each access aperture 64 constitute the opposed latching pawls 62 and 63. The access aperture 64 may be selectively closed by a race cover plate 65.

The cover plates 65 each have a substantially flat central portion 66 bounded by a pair of longitudinally extending, first and second latching rails 68 and 69. The latching rail 68 cooperatively interacts with the latching pawl 62, and latching rail 69 simultaneously interacts with latching pawl 63 to secure the cover plate 65 to the cap means 10 and close the race 60 from the elements. The cover plate 65 can be installed by engaging one latching rail 68 or 69 with the appropriate latching pawl 62 or 63 and then lightly tapping the cover plate 65 to force the other latching rail 69 or 68 into engagement with the other latching pawl 63 or 62. The cover plate 65 can also be installed before or after the cap means 10 is secured to the interior wall 14, either in the manner previously described, or by sliding the cover plate 65 longitudinally of itself, with the latching rails 68 and 69 engaged with the corresponding latching pawls 62 and 63.

Any of the cables 61 within the races 60 can be distributed into selected central cavities 56 of the panel members 16 or into the central cavity 70 of the panel connectors 18 through apertures 67 formed in the base extension walls 54. As shown, the cap means 10 also rests on the upper extremity 72 of the panel connectors 18 employed in wall 14 (which upper extremity is likely coplanar with the upper extremity 46 of the wall 14 itself). At least selected panel connectors 18, as shown in FIGS. 4 and 5, may also incorporate one or more races 73. Provision for a race 73 is made by furnishing a laterally spaced pair of hooked latch pawls 74 on the inner surface 75 of at least one of the four walls 36, 38, 39 or the wall 37, not shown, that define the body portion 35 of the panel connector 18 depicted in conjunction with the wall 14. The opposingly directed latching fingers 76 on the outer edges of the side walls 78 of the U-shaped cover 79 can engage the hooked latch pawls 74 to secure the U-shaped cover 79 to the interior of the panel connector 18 in order that the U-shaped cover 79 may define the race 73.

The spaced apertures 67 penetrate the base extension wall 54 to provide access between the races 60 and 73. The apertures 67 thus permit the cables 61 to pass between the races 60 and 73. The ability to have electric cable available in the walls 14 facilitates the provision of switches and outlets. Because the spacing of the connecting panels 18 is consistent for all of the walls and roofs structures, the apertures 67A and/or 67B can be formed in the base extension walls 54A and/or 54B prior to shipment of the cap means 10 to the erection site, thus eliminating the need for drills or hole punches at the erection site.

Inasmuch as a cap means 10 preferably runs along the entire length of the interior wall 14, the race 60 will permit easy installation of, and access to, any electrical cables $61_A$, $61_B$ and/or $61_C$ strung therein. The aforesaid concept makes it convenient to run cables 61, even after the cap means 10 is been installed in the building 11. In that regard it should be noted that whereas a race 60 is shown on both sides of the cap means 10, only one, or none, need be employed.

It must be appreciated that the top wall 50 of the cap means 10 is multi-functional. With continued reference to FIG. 2, for example, it will be observed that the top wall 50 may serve as a closure wall for the structure of a connecting tongue 80 that is presented from the cap means 10. Specifically, the top wall 50 is offset from the shoulder surface 81 on each race wall 53. A locking wall 82 is connected to each lateral edge of the top wall 50 and extends perpendicularly from the top wall 50 toward the base 45 to intersect a race wall 53. A longitudinally extending locking groove 83 is interposed between each locking wall 82 and the race wall 53 to which that locking wall 82 is conjoined. As such, a locking grooves 83 is recessed into each locking wall 82 at the juncture of the locking wall 82 with the shoulder surface 81 presented from the appropriate race wall 53. It should be further noted that the transverse thickness of the tongue 80 is less than the transverse thickness of the cap means measured between the exterior surfaces 84A and 84B on the respective mounting flanges 55A and 55B. This deliberate disparity between the transverse thickness of the connecting tongue 80 and the remainder of the cap means 10 accomplishes a similar purpose to that accomplished by the disparity between the tongue 25 and the body portion 19 of the wall panel 16.

Even though there is a modest dimensional disparity between the width of the connecting tongue 80 and the width of the cap means 10 measured between the opposite central portions 66A and 66B of the race cover plates 65A and 65B. Each locking wall 82 and the central portion 66 of adjacent cover plate 65 comprise the laterally spaced sides of the generally rectangular body portion 44 of the cap means 10.

With particular reference to FIG. 5 it can be noted that a secondary coupling connector 85 may also be employed to effect a structural tie between two linearly oriented members. The secondary coupling connector 85 is particularly adapted for use at those locations where the additional columnar strength afforded by the primary panel connector 18 is not required. For example, secondary coupling connectors 85 may be alternated with the primary panel connectors 18 in the construction of walls 12, 13 or 14, assuming that sufficient columnar strength for the particular wall can be achieved by so alternating the coupling connectors 18 and 85 and also assuming that the wall need be secured to its foundation only at the alternate locations of the panel connectors 18. The construction of a roof requires little, if any, resistance to columnar stresses in comparison to the resistance against potentially high bending stresses. The secondary coupling connector 85 is, therefore, particularly suited to usage in the construction of roofs and beams, as will be hereinafter more fully described.

Turning, then, to a preferred configuration for the construction of the secondary coupling connector 85 it can be seen from FIG. 5 that the secondary coupling connector 85 employs a web portion 86 with first and second pairs of connecting flanges 41 extending outwardly from the web portion 86 in diametrically opposite directions.

As will be apparent by comparing the secondary coupling connector 85 depicted in FIG. 5 with the panel connector 18 depicted in FIG. 4, the connecting flanges 40 incorporated on the secondary coupling connector 85 present connecting sockets 42A and 42B that are identical with the connecting sockets formed by the flanges incorporated in the panel connector 18. As such, the description of the connecting flanges 40 need not, therefore be reiterated. In this situation, because the identical elements are incorporated in a separate structural component, the same basic alphanumeric designations have been applied to the various elements of the connecting manges incorporated in the secondary coupling connector 85 as appear in conjunction with the connecting flanges described in conjunction with the panel connector 18 described in conjunction with FIG. 4 so that one may refer to the description of the panel connector 18 should any question arise relative to the structural arrangement of the connecting flanges employed with the secondary coupling connector 85 depicted in FIG. 5. However, because both opposed pairs of the connector flanges 40 are depicted, the distinction between the opposed pairs shall be accomplished by the use of a letter subscript. A letter subscript shall also be employed to identify similar, or identical, structural components associated with a member that is employed to accomplish two distinct purposes. As such, the letter subscript convention shall be employed to distinguish the components of a panel member 16 when a virtually identical structure is used as a ridge beam 90.

In some structures it will be desirable to provide a connection between the cap means 10 and a ridge beam 90 which is constructed in a manner similar to the panel members 16 from which the walls 12, 13 and/or 14 are formed. That is, the ridge beam 90 has skin walls $20_A$ and $21_A$ that are interconnected by reinforcing webs $22_A$ and edge connectors in the form of connecting tongues $25_A$. The thickness of the skin walls $20_A$ and $21_A$ in a ridge beam 90 may be required to be greater than the thickness of the corresponding skin walls 20 and 21 in a panel member 16 used in a wall 12, 13 or 14 inasmuch as the ridge beam 90 will support the roof 15.

The tongue $25_A$ adapted to permit connection of the ridge beam 90 with the cap means 10 through a secondary coupling connector 85. On pair of locking pawls $43A_A$ and $43B_A$ on extension arms $41A_A$ and $41B_A$, respectively, (which form connecting socket $42_A$) engage the locking grooves $30A_A$ and $30B_A$ in the tongue $25_A$ of the ridge beam 90, and the oppositely directed pair of locking pawls $43A_B$ and $43B_B$ on extension arms $41A_B$ and $41B_B$ (which form connecting socket $42_B$) engage the respective grooves 83A and 83B in the cap means 10. Because of the disparity between the thickness of the tongues $25_A$ and the body portion $19_A$ in the ridge beam 90, as well as the corresponding disparity in the cap means 10, as previously described, a smooth, exterior surface is presented between the ridge beam 90 and the secondary coupling connector 85. The ridge beam 90 may extend longitudinally between the end walls 13 of the building structure 11, and the interior wall 14 may, or may not, be coextensive with the ridge beam 90, but to the extent that those structural components are coextensive, the connection therebetween the beam strength required of the ridge beam 90 will be reduced.

Another of the functions provided by the top wall 50 of the cap means 10 is to support privacy panels. As best seen in FIG. 3, a privacy panel 91 may be supported from, and be slidably received within, one or both of the grooves 51. Depending upon the nature of the panel 91 it can provide some degree of privacy between adjacent rooms separated by an interior wall 14 that does not extend to the interior surface of the roof 15. Also, if the building is used commercially, as for example, a professional building such as a medical facility, a short wall can be provided to separate the receptionist from the clients. In that situation it is sometimes desirable to have a sliding window at the receptionist's position.

With particular reference, then, to FIG. 3 a privacy panel 91A in the form of an sheet of material may be received in one, or both, of the grooves 51. The sheet forming panel 91A may be either opaque or it may be a translucent, or transparent, sheet of material such as glass. In any event, panel 91A may be slidably received with the groove 51A, as represented. Conversely, the pane)(s) may be fixedly secured within each groove 51. As represented, the panel 91B may be fixed by the sealing compound 92 employed between the panel 91B and the groove 51B. Once one understands the concept of mounting a panel 91 within a groove 51, it will be appreciated that the individual grooves 51 may support individual panels or a single panel may be constructed so that it will simultaneously interact with both grooves 51.

Figure 6:
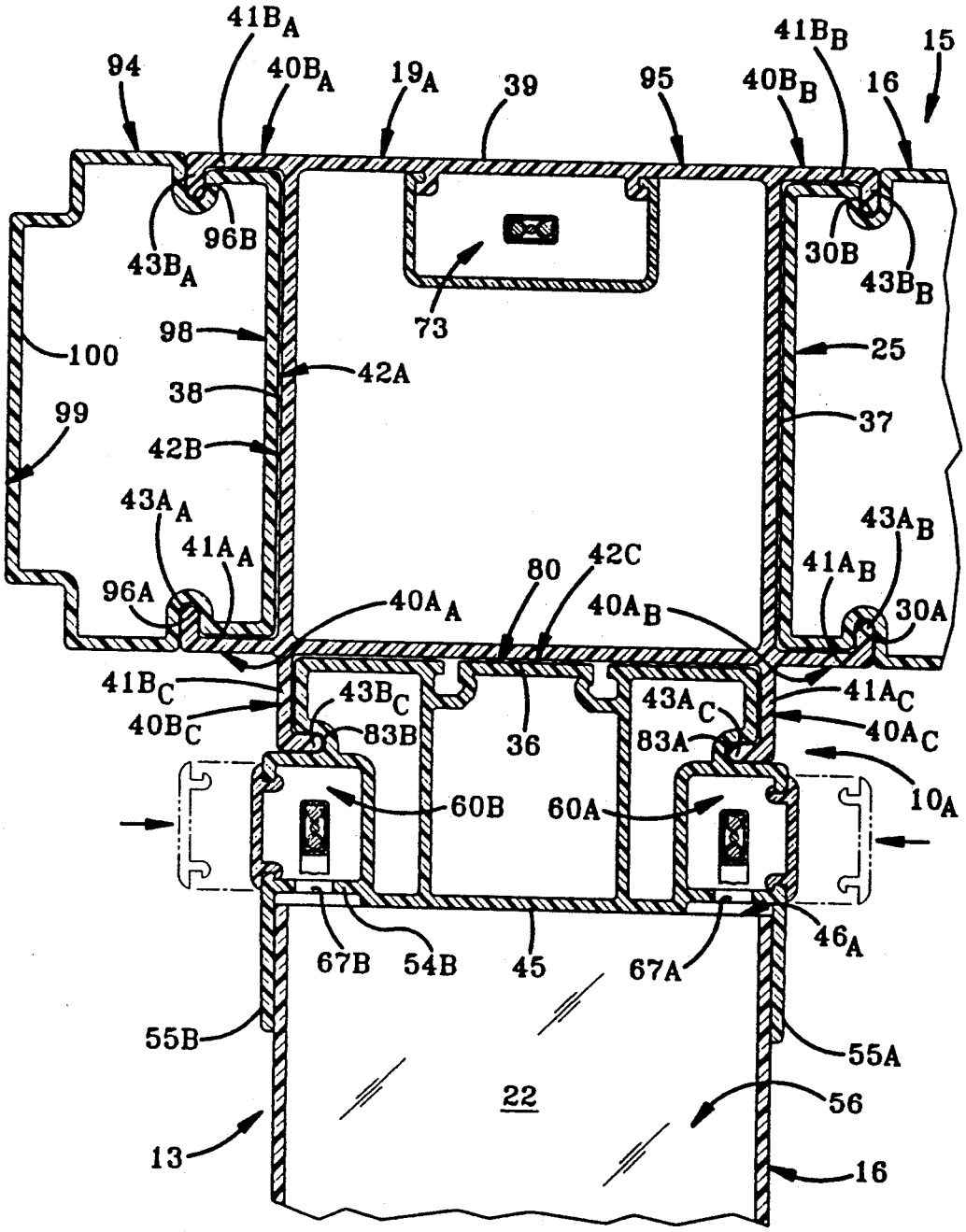

Turning now to FIG. 6, the end wall 13 of the building structure 11 supports the outer edge of the roof 15 and accordingly is fabricated to provide a sloping upper extremity $46_A$ to accommodate the pitch of the roof 15. The end wall 13 is also formed from panel members 16 that have a plurality of central cavities 56 that are preferably closed, and they may be closed, or covered, in the same manner as the central cavities 56 in the interior wall 14. That is, cap means 10 may be employed for that purpose, and in this situation the cap means 10 constitutes an eave rake, hereinafter identified by the alphanumeric designation $10_A$. As such, the eave cap $10_A$ has a cross-sectional structure identical with the structure of the cap means 10.

The eave cap $10_A$ may not only be supported on the end wall 13 in the same manner as the cap means 10 was described as resting on the interior wall 14, but the eave cap $10_A$ may also be connected to the roof 15 and a bargeboard 94 by a three-way panel connector 95. The three-way panel connector 95 constitutes a minor variation of the panel connector 18 previously described herein.

As will be recalled from that previous description, the panel connector 18 has two pair of connecting flanges 40 extending outwardly in opposite directions from the body portion 19. In addition to the pair of connecting flanges $40A_A$ and $40B_A$ extending outwardly from face 38 to form a connecting socket 42A, and the second pair of connecting flanges $40A_B$ and $40B_B$ extending outwardly from face 37 to form a connecting socket 42B (both of these pairs are included in panel connector 18, as partially shown in FIG. 4), the three-way panel connector 95 also includes a third pair of connecting flanges $4OA_C$ and $4OB_C$, not present in panel connector 18, which extend outwardly from face 36 on the body portion $19_A$ to form a connecting socket 42C. As such, the only face 39 on the body portion $19_A$ of panel connector 95 is smooth. Each of the other three exterior faces 36, 37 and 38 are provided with extension arms 41 that which terminate in locking pawls 43.

Specifically, the extension arms $41A_A$ and $41B_A$, and the respective locking pawls $43A_A$ $43B_A$ presented therefrom, cooperatively engage the grooves 96A and 96B, respectively, on the connecting tongue 98 on the bargeboard 94 in the same manner as the connecting flanges 40 cooperate with the connecting tongues 25 in the previously described usages of the cap means 10. The exterior face 99 on the bargeboard 94 may present whatever configuration that can be conveniently extruded. As shown, a decorative relatively wide rib 100 may be employed. The respective locking pawls 43A$_B$ and 43B$_B$ presented from extension arms 41A$_B$ and 41B$_B$ cooperatively engage the locking grooves 30A and 30B on the connecting tongue 25 presented from the adjacent panel member 16 of the roof 15. The locking pawls 43A$_C$ and 43B$_C$ presented from extension arms 41A$_C$ and 41B$_C$ cooperatively engage the locking grooves 83A and 83B associated with the tongue 80 on the eave cap 10$_A$.

As represented in FIG. 6, the eave cap 10$_A$ can, if desired, also be provided with races 60 for electrical cables. Such races may conveniently have the same configuration as the races 60 previously shown and described in conjunction with the cap means 10. Providing races 60 in the eaves cap 10$_A$ facilitates routing the electrical cables from one side of the building structure 11 to the other. If that arrangement is employed, one can effect communication into the races provided in the panel connectors 18 employed in the end wall 13, as through apertures 67A and 67B that penetrate the base extension walls 54A and 54B, respectively, of the eave cap 10$_A$.

It should also be appreciated that one may also, if desired, provide a race 73 within the three-way connector 95. The race 73 could well have the same configuration as the race 73 in the panel connector 18. Accordingly it need not, therefore, be further described herein.

The longitudinal ends of the eave cap 10$_A$ may be prepared, by cutting the proper pitch angle thereon prior to shipment to the erection site in order to obviate the need for a cutting toot at the erection site.

As should now be apparent, the present invention not only teaches that a cap means embodying the concepts of the present invention can be used structurally to close the open end of one or more wall, or roof, panel members while providing platform for supporting other components of a modular building structure, but also teaches that a cap means can be used as an eave cap and otherwise accomplish the objects of the invention.

I claim:

1. A cap means for use in combination with a modular building structure having one or more walls, said walls each having an upper extremity, said cap means comprising:

a body portion;

said body portion having a horizontally disposed base supported upon, and in continuous contact along a substantial length with, the upper extremity of one or more of the walls incorporated in the modular building structure when said cap means is installed thereon;

mounting flanges extending downwardly from said base and adapted to embrace the upper extremity of the wall upon which said base is supported;

a top wall extending transversely, and longitudinally, of said cap means;

said top wall having lateral edges; and, a locking wall connected to each lateral edge of said top wall and extending substantially perpendicularly from said top wall toward said base to terminate in a locking groove extending longitudinally of said top wall to constitute a connecting means located in spaced relation upwardly of said base.

2. A cap means, as set forth in claim 1, wherein said connecting means further comprises:

at least one receiving groove extending longitudinally of said top wall; and, a privacy panel received in at least one of said receiving grooves.

3. A cap means, as set forth in claim 1, further comprising:

at least one cable race interposed between said locking groove and said base.

4. A cap means, as set forth in claim 3, further comprising:

a longitudinally extending aperture to provide access to said cable race;

a cover plate selectively to close said access aperture;

a pair of opposed, longitudinally extending latching pawls presented from said body portion on either side of said access aperture;

a pair of latching rails on said cover plate adapted cooperatively to engage said latching pawls for removably securing said cover plate to said body portion.

5. A cap means for enclosing an upper extremity of one or more walls in a modular building structure, said cap means comprising:

a body portion;

said body portion having a horizontally disposed base adapted to be supported upon the upper extremity of one or more walls incorporated in the modular building;

mounting flanges extending downwardly from said base and adapted to embrace the upper extremity of the wall upon which said base is supported;

said body portion also having a connecting means located in spaced relation upwardly of said base;

said connecting means incorporating a top wall extending transversely, and longitudinally, of said cap means;

a pair of risers extending between said base and said top wall;

at least one, laterally disposed race wall extending longitudinally of said cap means and located laterally outwardly of at least one riser and between said base and said connector means in parallel relation with said base;

at least one intermediate riser located laterally outwardly of at least one said riser and extending upwardly from said base to intersect said race wall;

said base, said intermediate riser and said race wall defining a cable race interposed between said base and said connecting means.

6. A cap means, as set forth in claim 5, wherein:

at least one of the one or more walls has a plurality of substantially vertically oriented cavities;

a cable race provided within selected cavities; and, a plurality of apertures through said base to effect communication between said cable race in said cap means and the cable race in one or more of said selected cavities.

7. A cap means, as set forth in claim 5, wherein said connecting means further comprises:

lateral edges on said top wall extending longitudinally of said cap means;

a locking wall connected to each lateral edge of said top wall and extending substantially perpendicularly from said top wall toward said race wall;

a locking groove interposed between said locking wall and said race wall;

said top wall, said locking walls and said locking grooves forming a connecting tongue.

8. A cap means, as set forth in claim 7, further comprising:

a longitudinally extending aperture to provide access to said cable race;

a cover plate selectively to close said access aperture;

a pair of opposed, longitudinally extending latching pawls presented from said body portion on either side of said access aperture;

a pair of latching rails on said cover plate adapted cooperatively to engage said latching pawls for removably securing said cover plate to said body portion.

9. A cap means, as set forth in claim 8, wherein said connecting means further comprises:

at least one receiving groove extending longitudinally of said top wall; and, a privacy panel received in at least one of said receiving grooves.

10. In combination with the walls in a modular building structure, a cap means for use in conjunction with the upper extremity of one or more of the walls, said cap means comprising:

a body portion;

said body portion having a horizontally disposed base adapted to supported upon the upper extremity of one or more walls incorporated in the modular building;

mounting flanges extending downwardly from said base and adapted to embrace the upper extremity of the wall upon which said base is supported;

a top wall extending transversely, and longitudinally, of said cap means;

a top wall having lateral edges;

a locking wall connected to each lateral edge of said top wall and extending substantially perpendicularly from said top wall toward said base to terminate in a locking groove;

said top wall, said locking walls and said locking grooves forming a connecting tongue on said cap means;

a ridge beam to support the apex of a roof;

said ridge beam having a connecting tongue disposed in opposition to said connecting tongue on said cap means; and, a coupling member to conjoin said opposed connecting tongues.

11. In combination with the wall sin a modular building structure, a cap means for use in conjunction with the upper extremity of one or more of the walls to support a roof panel, said cap means comprising:

a body portion;

said body portion having a horizontally disposed base adapted to supported upon an upper, inclined extremity of an end wall incorporated in the modular building;

mounting flanges extending downwardly from said base and adapted to embrace the upper extremity of the modular building, inclined end wall upon which said base is supported;

a top wall extending transversely, and longitudinally, of said cap means;

said top wall in said cap means having lateral edges;

a locking all connected to each lateral edge of said top wall in said cap means and extending substantially perpendicularly toward said base to terminate in a locking groove;

said cap means top wall, said locking walls and said locking grooves forming a connecting tongue on said cap means;

a panel connector;

said panel connector having a first socket to effect mating connecting with said connecting tongue on said cap means;

a second socket presented from said panel connector in substantially perpendicular disposition with respect to said first socket;

a connecting tongue presented from said roof panel to effect a mating connecting with said second socket.

12. A combination, as set forth in claim 11, further comprising:

a third socket presented from said panel connector in substantially perpendicular disposition with respect to said first socket and linearly disposed to said second socket;

a bargeboard having a connecting tongue adapted matingly to engage said third socket.

* * * * *